US008038010B1

(12) United States Patent
Rometty et al.

(10) Patent No.: US 8,038,010 B1
(45) Date of Patent: Oct. 18, 2011

(54) SINGLE PIECE EDGE PROTECTOR FOR CURVED OBJECTS

(75) Inventors: John A. Rometty, Barrington, IL (US); Nancy Roach, Cincinnati, OH (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/816,857

(22) Filed: Jun. 16, 2010

Related U.S. Application Data

(63) Continuation of application No. 12/698,804, filed on Feb. 2, 2010, now abandoned.

(51) Int. Cl.
*B65D 81/02* (2006.01)
*B65H 19/28* (2006.01)

(52) U.S. Cl. ..... 206/586; 206/53; 206/400; 206/453; 242/579

(58) Field of Classification Search ..... 206/53, 206/303–304.1, 398–400, 413–414, 453, 206/586; 242/170, 532.4, 579, 580
See application file for complete search history.

(56) References Cited

U.S. PATENT DOCUMENTS 1,646,593 A * 10/1927 Peterson ..... 206/400
1,989,183 A * 1/1935 Blake ..... 206/414
3,645,386 A * 2/1972 Takaichi et al. ..... 206/413
3,836,094 A * 9/1974 Hollingsworth ..... 242/579
3,955,777 A * 5/1976 Burdorf ..... 242/579
4,513,864 A * 4/1985 Liebel ..... 206/396
4,898,279 A * 2/1990 Linnemann ..... 206/586
5,513,819 A 5/1996 Orange
6,183,840 B1 * 2/2001 Arrowsmith ..... 206/398
6,458,448 B1 * 10/2002 Hunt ..... 206/398
6,868,969 B2 3/2005 Gosis et al.
7,080,734 B1 * 7/2006 Morris et al. ..... 206/400

* cited by examiner

*Primary Examiner* — Byron Gehman
(74) *Attorney, Agent, or Firm* — Levenfeld Pearlstein, LLC

(57) ABSTRACT

A single piece edge protector for curved and curvilinear-shaped objects includes a preformed, rigid, laminated U-board having a bottom wall, and a first sidewall, and a second sidewall which include preformed angled cuts. The preformed cuts are formed at about 15 degrees from a plane perpendicular to the bottom wall. Each sidewall of the edge protector is a mirror-image of the other such that a preformed cut on the first sidewall is directly across from a preformed cut on the second sidewall. A plurality of preformed cuts form both V-shaped openings and a plurality of trapezoid-like legs on the first and second sidewalls. Each leg may have a similar surface area or a different surface area as an adjacent leg along the length of the edge protector. The edge protector is configured to follow a curvilinear perimeter of about 135 degrees and may include an end cap closure.

16 Claims, 5 Drawing Sheets

SINGLE PIECE EDGE PROTECTOR FOR CURVED OBJECTS

CROSS REFERENCE TO RELATED APPLICATIONS

This application is a continuation of, and claims priority to, U.S. patent application Ser. No. 12/698,804, filed Feb. 2, 2010, now abandoned, which is hereby incorporated by reference herein in its entirety.

BACKGROUND OF THE INVENTION

The present invention is directed to protective packaging. More particularly, the present invention pertains to protective packaging for curved and curvilinear objects.

Small objects or objects having linear sides can easily be packaged in boxes for protection. Also; large objects having straight sides can be protected with bubble wrap or rigid edge protectors. U-shaped packaging containers, or U-boards, are known packaging material for many such objects. The board is formed from a layered, or laminated, construction of paper and/or paper board that is subsequently formed into a U-shape (U-shaped cross-section). The board generally is rigid; that is, the walls are rigidly formed into the U-shape (transverse relative to the base) and are rigid longitudinally along the length of the channel. The walls do not fold down onto the base, nor can the board, without more, be folded length-wise onto itself.

Unfortunately, many objects needing packaging have curved or irregular edges, such as tables, frames, J-tracks for garages, and the like. The curved, curvilinear, or irregular shape of such objects makes it difficult to adequately protect the object during transit, particularly with regard to the perimeter, which is subject to the greatest stresses and opportunity for damage during handling.

An irregularly-shaped object is typically placed within a larger, bulky box that is filled with filler or cushioning material so that the object is not jostled within the box. Other times a large, curved object is wrapped in bubble wrap or other bulky material. While effective, both packaging mechanisms cause undue waste and expense.

Linear U-boards are sometimes used to package curved or curvilinear items as well. However, even U-boards that allow bending of the U-board of about 90 degrees often have cuts which are straight or perpendicular to the bottom of the U-board. These straight cuts, however, may not be effective in allowing the U-board to bend more than 90 degrees from the horizontal. As such, these straight-cut U-boards may not be conducive to protecting, for example, S-shaped objects having more than one curve and/or presenting a curve greater than 90 degrees.

Accordingly, there is a need for packaging for curved or curvilinear objects. Desirably, such packaging reduces waste, is environmentally friendly, and is moldable around various curvilinear shapes and sizes.

BRIEF SUMMARY OF THE INVENTION

A single piece edge protector for curved and curvilinear-shaped objects includes a preformed, rigid, laminated U-board having a bottom wall, and first and second sidewalls which include preformed angled cuts. The preformed cuts are formed at about 15 degrees from a plane perpendicular to the bottom wall of the U-board. Each sidewall of the edge protector is a mirror-image of the other such that a preformed cut on the first sidewall is directly across from and corresponds to a preformed cut on the second sidewall. In addition, a plurality of the preformed cuts form generally V-shaped openings in both the first sidewall and in the second sidewall of the U-board; thus, the V-shaped openings on the first sidewall are directly across from the generally V-shaped openings on the second sidewall in an initial position. The preformed cuts are formed such that a width of an opening formed by the preformed cuts increases from a bottom of the opening to a top of the opening.

The plurality of preformed cuts on the first sidewall and the plurality of preformed cuts on the second sidewall form a plurality of legs on the first and second sidewalls. Each of the legs have a generally trapezoid-like shape, and each leg may have a similar surface area or a different surface area as an adjacent leg along the length of the edge protector. In an embodiment, each leg of the edge protector has a height H.

The edge protector is configured to allow for following or bending around a curved perimeter or a curvilinear perimeter of the object to be packaged. The preformed cuts are biased to facilitate curvature of the edge protector around a perimeter of the object, such that the edge protector is able to protect shapes ranging from linear stretches to shapes having curved portions of about 0 to 135 degrees or more.

The edge protector, in an embodiment, includes an end cap closure. The edge protector can be mounted to the curved or the curvilinear object in several different manners, including using, for example, friction or snug fitting, adhesive, rope, metal or plastic strap, and/or plastic film.

These and other features and advantages of the present invention will be apparent from the following detailed description, in conjunction with the following figures and appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
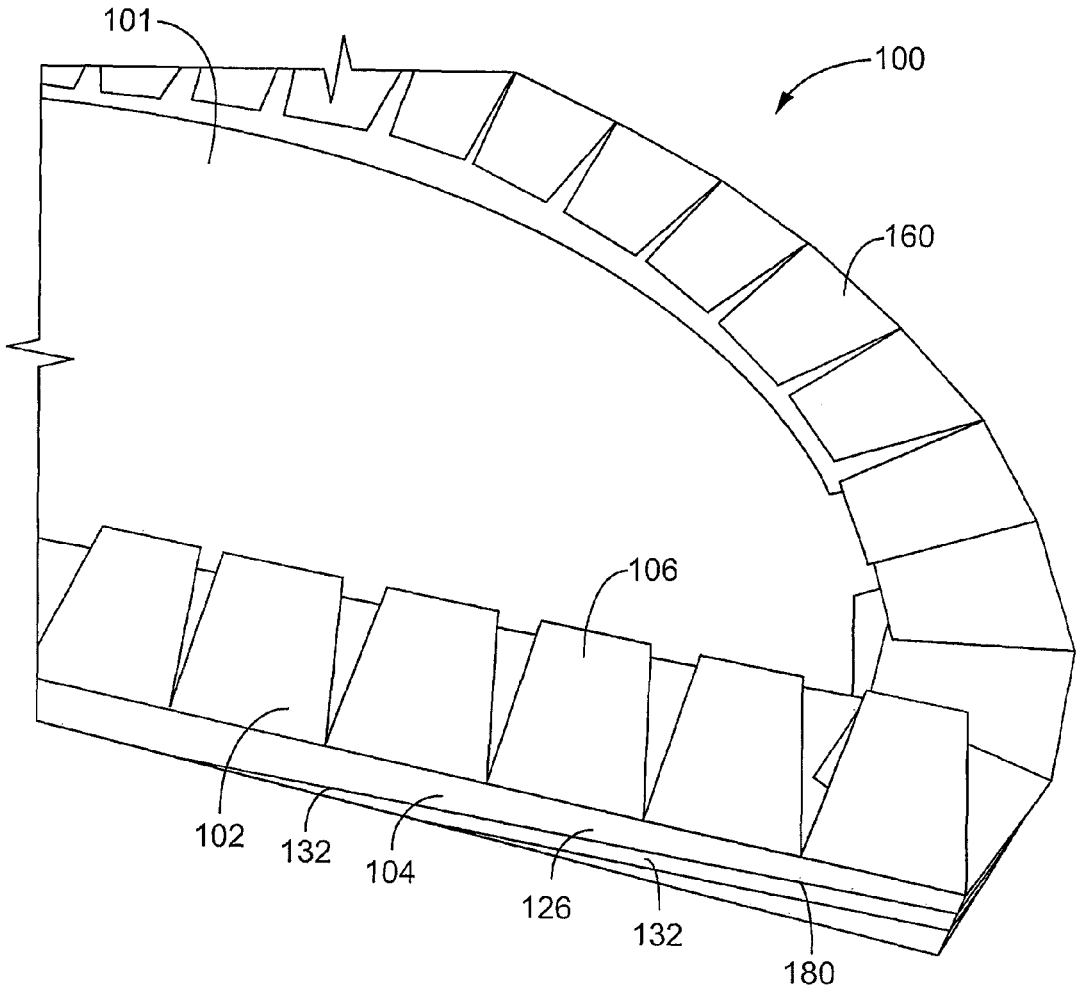
FIG. 1 is a perspective view of a single piece edge protector in accordance with the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIGS. 1, 2A, 2B, and 2C, a single piece edge protector 100 for curved and curvilinear-shaped objects 101 includes a preformed, rigid, laminated U-board 102 having a bottom wall 104, a first sidewall 106, and a second sidewall 108. The first sidewall 106 and the second sidewall 108 include preformed cuts 112, 114.

The preformed cuts 112, 114 are formed at about 15 degrees (113, 115) from a plane 117 perpendicular to the bottom wall 104 of the U-board 102. Each sidewall 106, 108 of the edge protector 100 is a mirror-image of the other, such that a preformed cut 112, 114 on the first sidewall 106 is parallel to and directly across from (i.e. corresponds to) a preformed cut 112, 114 on the second sidewall 108. In addition, the preformed cuts 112, 114 form generally V-shaped openings 116 in the first sidewall 106 and the second sidewall 108 of the U-board 102. The preformed cuts are formed such that a width of the generally V-shaped opening formed by the preformed cuts increases from a bottom shown generally at 127 to a top of the opening. The V-shaped openings 116 on the first sidewall 106 are directly across from the V-shaped openings 116 on the second sidewall 108. The preformed cuts 112, 114 may be biased cut.

The plurality of preformed cuts 112, 114 on the first sidewall 106 and the plurality of preformed cuts 112, 114 on the second sidewall 108 also form a plurality of legs 118 along a length L of the edge protector 100. The legs 118 have a generally trapezoid-like shape 110 such that a top 120 and a bottom 122 of the legs 118 are parallel to each other and the sides 124, 126 of the legs are at an angle to each other. Each leg 118 has a height H, the perpendicular distance between the bottom of a leg 122 and the top 120 of a leg 118. Each leg may have a similar surface area A or a different surface area as an adjacent leg along the length L of the edge protector 100. That is, the legs 118 can have the same or different surface areas than other (e.g. adjacent) legs. In addition, in an embodiment, the preformed cuts 112, 114 may be bias cut 138 such that the legs 118 flare in an outward direction 139, as shown in the top view of the U-board 100 in FIG. 2B.

Figure 2A:
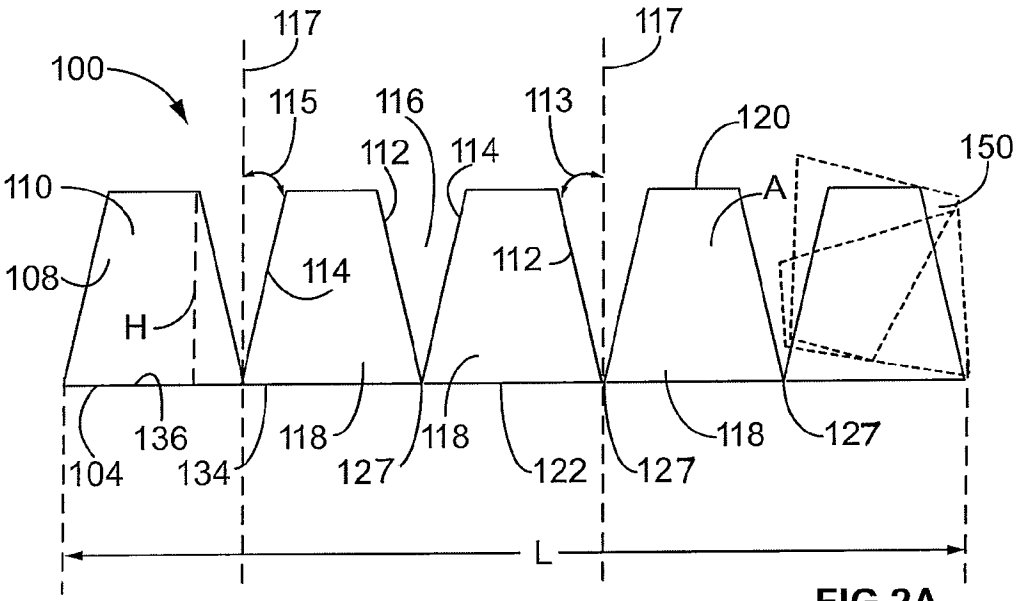
FIG. 2A is a front view of the single piece edge protector.
Figure 2B:
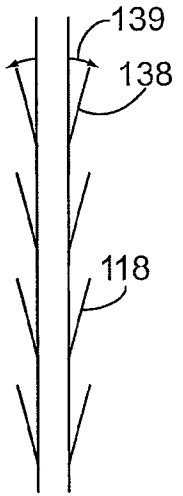
FIG. 2B is a top view of an embodiment of the single piece edge protector.
Figure 2C:
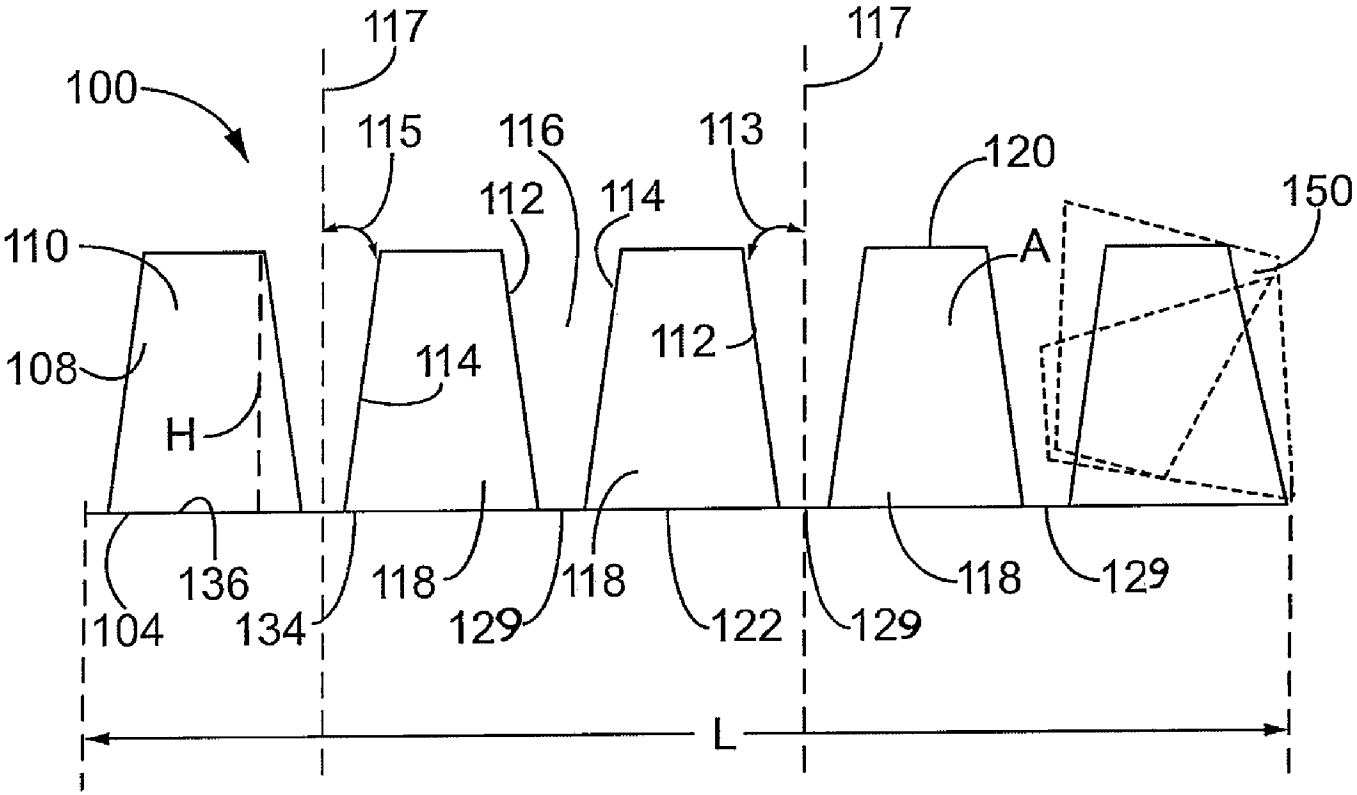
FIG. 2C is a front view of another embodiment of the single piece edge protector.

In one embodiment, shown in FIG. 2A, the bottom ends of the preformed cuts, shown generally at 127 join at the bottom of the edge protector 100, while in another embodiment, shown in FIG. 2C, the preformed cuts 112, 114 are distanced a length, shown generally at 129, between two adjoining legs. Again, the length 129 may be consistent or vary throughout the length of the edge protector 100.

The bottom wall 104, may be scored 132 (FIG. 1) to facilitate bending of the edge protector 100. The scoring 132 may be on an interior surface 134 of the bottom wall 104 or on an exterior surface 136 of the bottom wall 104. Alternatively, the material along the bend line (or at scoring 132) can be compressed to facilitate bending.

The edge protector 100, in an embodiment, includes an end cap closure 150. The edge protector 100 can be mounted to the curved or the curvilinear object using friction or snug fitting, adhesive, strap, and/or plastic film 160. It will be appreciated that the end cap can be formed by bending or folding one or more of the legs 118 inward, onto the edge protector 100 itself.

Figure 3:
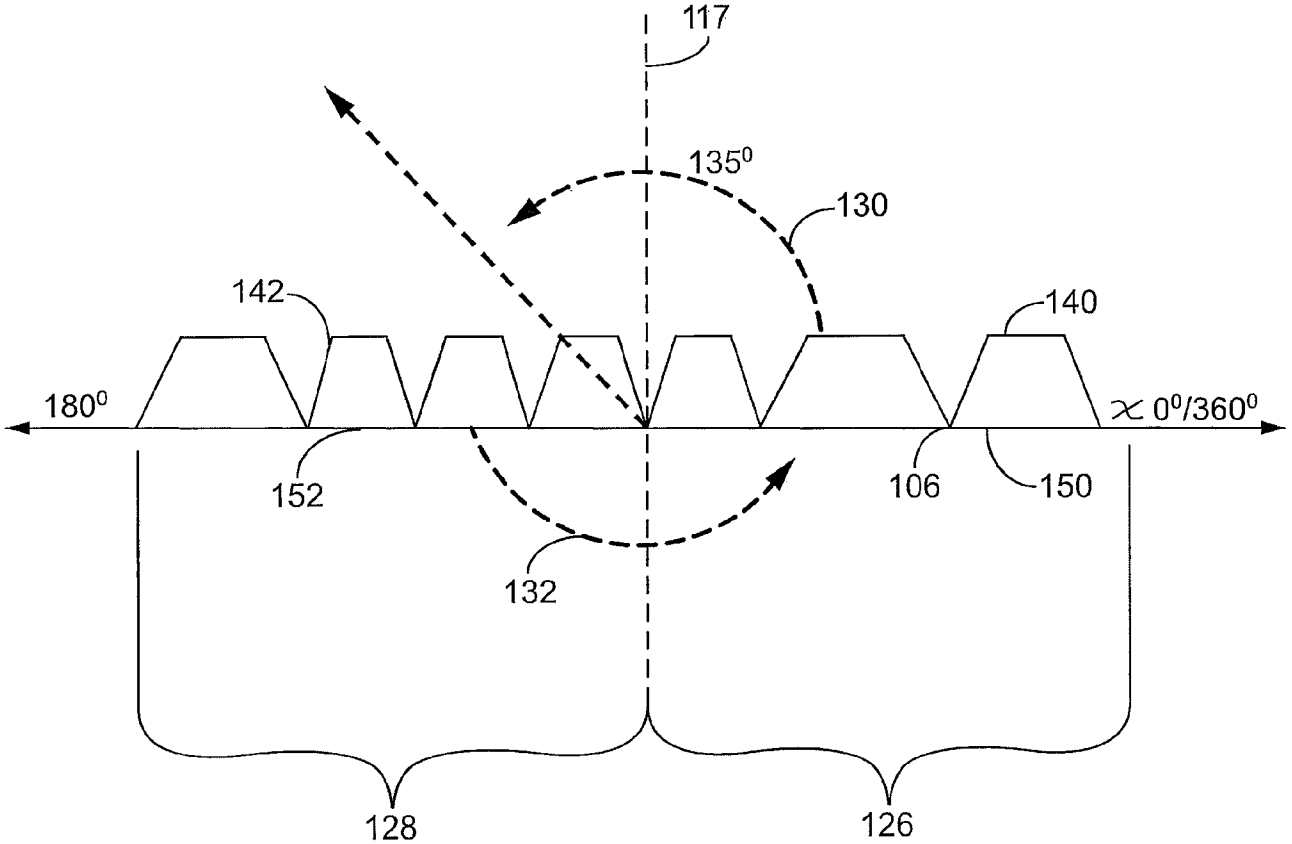
FIG. 3 is a diagram representing examples of curvatures around which the single piece edge protector is configured to bend.

The edge protector 100 follows a curved perimeter P or a curvilinear perimeter P of the object 101. FIG. 3 illustrates the range of curvature of the edge protector 100. In one configuration, the edge protector 100 can be folded or curved in a forward direction 130 in which a first portion 126 of the edge protector 100 can be curved, up to about 135 degrees from the horizontal x such that the top surface 140 of the first portion 126 is about 45 degrees from a top surface 142 of a second portion 128. In another embodiment, the second portion 128 is curved in a reverse direction 132 such that the bottom walls 150, 152 of the first portion 126 and the second portion 128 respectively, are adjacent to one another. The preformed cuts 112, 114 may be biased cut to facilitate curvature of the edge protector 100 around a perimeter P of the object 101, such that it is able to protect objects 101 having shapes ranging from linear stretches to objects having shapes with curved portions of about 135 degrees.

Figure 4:
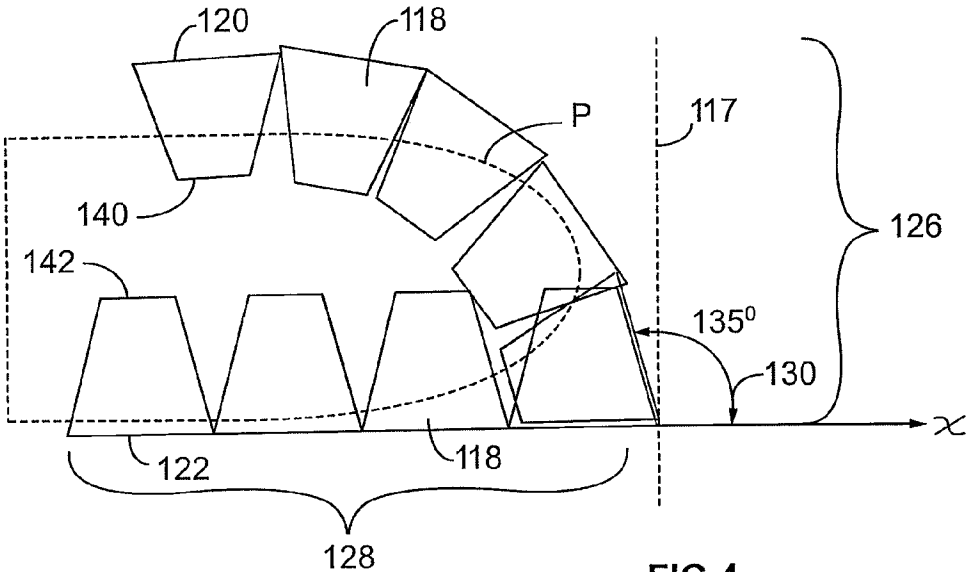
FIG. 4 is a front view of an embodiment of the edge protector curved in a forward direction.

FIG. 4 illustrates the edge protector 100 folded in a forward position 130. A first portion 126 of the edge protector 100 is folded such that the top 140 of the first section 126 is within 45 degrees of the top 142 of the second section 128.

Figure 5:
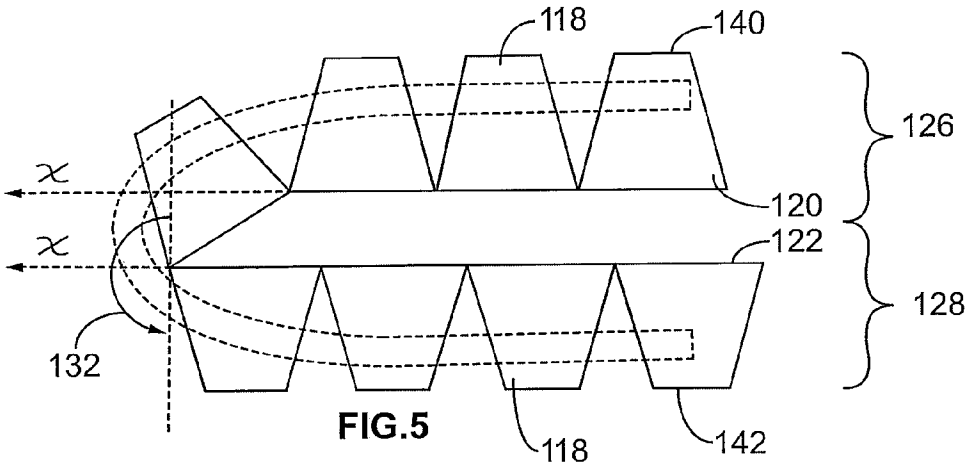
FIG. 5 is a front view of an embodiment of the edge protector curved in a reverse direction.

In another configuration, shown in FIG. 5, the second portion 128 has been folded in a reverse direction 132 such that the bottom wall 122 of the second section 128 is almost parallel to the bottom 120 of first section 126. The edge protector can be used to protect, for example, clerestory or eyebrow windows, blinds, and the like.

The advantages of the present single piece edge protector will be appreciated by those with skill in the art. The flexibility of movement of the rigid edge protector allows for protection of even the most irregularly shaped objects while decreasing waste and expense. In addition, having the legs and preformed cuts parallel or directly across from each other along the length of the edge protector facilitates bending of the edge protector neatly and cleanly, in for example, a 90 degree angle, without undue twists, folds, or turns in the edge protector. Also, the present edge protector allows for folding of the edge protector in a variety of different positions in order to fully protect a curved or curvilinear object. The edge protector is both rigid and flexible; scoring on one or both of an interior and an exterior of the bottom wall facilitates the folding of the edge protector, while the sidewalls remain rigid. The present edge protector reduces waste and expense while providing close, needed protection to curved or curvilinear objects.

All patents referred to herein, are incorporated herein by reference, whether or not specifically done so within the text of this disclosure. In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A single piece edge protector for a curved object comprising:

a laminated U-board having a bottom wall, a first sidewall, a second sidewall, and an end cap closure, the U-board being rigid such that the first and second sidewalls do not fold downward onto the bottom wall, the first sidewall and the second sidewall having preformed cuts formed at an angle about 15 degrees from a plane perpendicular to the bottom wall of the U-board, and wherein a preformed cut on the first sidewall corresponds to and is directly across from a preformed cut on the second sidewall, the preformed cuts formed such that a width of an opening formed by the preformed cuts increases from a bottom to a top of the opening, a plurality of preformed cuts on the first sidewall and a plurality of preformed cuts on the second sidewall form a plurality of legs along a length of the edge protector, and wherein the end cap closure is formed by bending at the bottom wall and having one or more of the plurality of legs overlap an adjacent leg.

2. The edge protector of claim 1 wherein the preformed cuts form generally V-shaped openings in the first sidewall and generally V-shaped openings in the second sidewall of the U-board, and wherein the V-shaped openings on the first sidewall are directly across from the V-shaped openings on the second sidewall.

3. The edge protector of claim 1 wherein the plurality of legs have a substantially trapezoidal shape.

4. The edge protector of claim 1 wherein the plurality of legs have a height and wherein a first leg of the plurality of legs has a different surface area than a second leg of the plurality of legs.

5. The edge protector of claim 1 wherein the edge protector follows a curved perimeter of the object.

6. The edge protector of claim 1 wherein the preformed cuts are biased to facilitate curvature of the edge protector around a perimeter of the object.

7. The edge protector of claim 1 wherein the edge protector is secured to the curved object using one or more of a friction fitting, a plastic film, an adhesive, and a strap.

8. The edge protector of claim 1 wherein the edge protector is secured along an inside curve of the curved object.

9. The edge protector of claim 1 wherein the bottom wall is scored along a length thereof to facilitate bending of the edge protector.

10. The edge protector of claim 1 wherein the U-board is configured to be folded in a forward direction in which a first portion of the U-board is curved up to about 135 degrees from horizontal such that a top surface of the first portion is about 45 degrees from a top surface of a second portion of the U-board, and wherein the U-board is configured to be folded in a reverse direction such that bottom walls of the first and second portions are adjacent one another.

11. A single piece edge protector for a curved object comprising:

a U-board having a bottom wall, a first sidewall, and a second sidewall, the U-board being substantially rigid such that the first and second sidewalls do not generally fold downward onto the bottom wall, the first sidewall and the second sidewall having a plurality of preformed cuts that form generally V-shaped openings in the first and second sidewalls of the U-board, and wherein the plurality of preformed cuts on the first and second sidewalls form a plurality of opposed legs that extend straight away from the bottom wall along a length of the edge protector, further wherein the preformed cuts are biased so that each of the plurality of legs flare in an outward direction away from a respective opposing leg.

12. The edge protector of claim 11 wherein the V-shaped openings on the first sidewall are directly across from the V-shaped openings on the second sidewall, and wherein the plurality of legs have a substantially trapezoidal shape.

13. The edge protector of claim 11 wherein the edge protector includes an end cap closure formed by bending at the bottom wall and having one or more of the plurality of legs overlap an adjacent leg.

14. The edge protector of claim 11 wherein the edge protector is secured along an inside curve of the curved object.

15. The edge protector of claim 11 wherein the bottom wall is scored along a length thereof to facilitate bending of the edge protector.

16. The edge protector of claim 11 wherein the U-board is configured to be folded in a forward direction in which a first portion of the U-board is curved up to about 135 degrees from horizontal such that a top surface of the first portion is about 45 degrees from a top surface of a second portion of the U-board, and wherein the U-board is configured to be folded in a reverse direction such that bottom walls of the first and second portions are adjacent one another.

* * * * *